US012209324B2

(12) United States Patent
Wei et al.

(10) Patent No.: US 12,209,324 B2
(45) Date of Patent: Jan. 28, 2025

(54) PREPARATION METHOD, PRODUCT AND APPLICATION OF COMPOSITE MEMBRANE WITH A SELF-REPAIRING FUNCTION

(71) Applicant: China Jiliang University, Zhejiang (CN)

(72) Inventors: Guoying Wei, Hangzhou (CN); Benfeng Zhu, Hangzhou (CN); Zhongquan Zhang, Hangzhou (CN)

(73) Assignee: China Jiliang University, Hangzhou (CN)

( * ) Notice: Subject to any disclaimer, the term of this patent is extended or adjusted under 35 U.S.C. 154(b) by 0 days.

(21) Appl. No.: 18/454,913

(22) Filed: Aug. 24, 2023

(65) Prior Publication Data

US 2023/0407515 A1 Dec. 21, 2023

Related U.S. Application Data

(63) Continuation of application No. PCT/CN2023/079965, filed on Mar. 7, 2023.

(30) Foreign Application Priority Data

Jun. 21, 2022 (CN) ..... 202210706540.6

(51) Int. Cl.
*C25D 21/14* (2006.01)
*C25D 3/56* (2006.01)

(52) U.S. Cl.
CPC ..... *C25D 21/14* (2013.01); *C25D 3/56* (2013.01)

(58) Field of Classification Search
None
See application file for complete search history.

(56) References Cited

U.S. PATENT DOCUMENTS

2010/0304179 A1 12/2010 Facchini
2017/0051156 A1 2/2017 Chilukuri

FOREIGN PATENT DOCUMENTS

| | | | | |
|---|---|---|---|---|
| CN | 101182645 | | 5/2008 | |
| CN | 101210305 | | 7/2008 | |
| CN | 103014819 | | 4/2013 | |
| CN | 110644026 | | 1/2020 | |
| CN | 111876812 A | * | 11/2020 | ..... C25D 11/22 |
| CN | 113684511 | | 11/2021 | |
| CN | 115029744 | | 9/2022 | |
| KR | 20090071162 | | 7/2009 | |

OTHER PUBLICATIONS

Li et al. (Composite Structures 235 (2020) 111773) (Year: 2020).*
Maruthi et al. (Plating and Surface Finishing: "Electrodeposition & Characterization of Co-W Alloys" 1999) (Year: 1999).*
Hu et al. (CN 111876812 A, machine translation). (Year: 2020).*
Sheng et al. (Journal of Alloys and Compounds 743 '2018' 682-690) (Year: 2018).*
Sen et al. (Journal of Alloys and Compounds 489 '2010' 650-658). (Year: 2010).*
International Search Report for PCT/CN2023/079965, mailed Jun. 20, 2023.

* cited by examiner

*Primary Examiner* — Wojciech Haske
(74) *Attorney, Agent, or Firm* — Pilloff Passino & Cosenza LLP; Rachel Pilloff; Sean Passino

(57) ABSTRACT

A preparation method, a product and an application of a composite membrane with a self-repairing function are provided by the present application, relating to the technical field of surface treatment of metallic materials. The preparation method includes the following steps: adding cobalt salt, tungsten salt, complexing agent and buffering agent into water to obtain a mixed solution, and adjusting a pH value to acidity to obtain an acidic solution; adding cerium oxide and surfactant into the acidic solution to obtain an electrolyte system; and placing a metal substrate in the electrolyte system for electrodeposition to obtain the composite membrane with self-repairing function. By means of constant potential composite electrodeposition on a metallic material substrate, the invention eventually forms a micron-scale composite membrane with a self-healing function and a thickness of 6-8 micrometers on the surfaces of the metallic materials.

6 Claims, 11 Drawing Sheets

PREPARATION METHOD, PRODUCT AND APPLICATION OF COMPOSITE MEMBRANE WITH A SELF-REPAIRING FUNCTION

CROSS-REFERENCE TO RELATED APPLICATIONS

This application is a continuation of PCT/CN2023/079965, filed on Mar. 7, 2023 and claims priority of Chinese Patent Application No. 202210706540.6, filed on Jun. 21, 2022, the entire contents of which are incorporated herein by reference.

TECHNICAL FIELD

The present application relates to the technical field of surface treatment of metallic materials, and in particular to a preparation method, a product and an application of a composite membrane with a self-repairing function.

BACKGROUND

Metallic materials are widely used in fields including electric power, electronics, energy, petrochemicals, machinery, metallurgy, transportation, light industry and emerging industries for their excellent properties such as good electrical conductivity, thermal conductivity, ductility, corrosion resistance and wear resistance. However, devices made of metallic materials are inevitably damaged by mechanical stress during service, and the surface is prone to the emergence of micro-fissures and even particle crushing, resulting in affected performance and shortened service life. For this reason, it has become increasingly important to treat the surface of metallic materials in order to repair the fissures and improve their serviceability. However, the problem of micro-fissures arising from within the device is not always easy to observe and repair. Inspired by the fact that biological systems in nature are self-healed upon damage, e.g. wounds on human skin heal themselves over time, it is possible to effectively extend the service life of devices and improve safety by introducing this self-healing capability into optoelectronic devices to allow spontaneous healing when they are damaged. Currently available self-healing composites fall into three categories: microcapsules, vascular-based and intrinsically self-healing materials. Microcapsule-based self-healing materials contain fluids capable of filling and sealing fissures which, when the material is damaged, cause some of the capsules to rupture, releasing the fluid and narrowing the gap, but the healing effect is uncertain due to the limited amount of healing agents; vascular-based self-healing materials have a similar mechanism to that of microcapsule-based self-healing materials, but research on this subject is developed slowly due to the undeveloped manufacturing technology; as for intrinsic self-healing materials, they are designed to heal through the inherent reversibility of chemical or physical bonding rather than structural design, and these products have not been used in practical applications as a result of the uncertain properties.

Therefore, it is of great significance to develop a composite membrane (coating) with self-repairing function to prolong the service life of metals.

SUMMARY

Based on the above contents, the present application provides a preparation method, a product and an application of a composite membrane with a self-repairing function. The composite film as a metal coating is capable of self-repairing (self-healing) when fissures are developed with a presence of corrosive medium $Cl^-$.

In order to achieve the above objectives, the present application provides following technical schemes:

one of the technical schemes of the present application provides a preparation method of a composite membrane with self-repairing function, including following steps:

step 1, adding cobalt salt, tungsten salt, complexing agent and buffering agent into water to obtain a mixed solution, and adjusting a pH value to acidity to obtain an acidic solution;

step 2, adding cerium oxide and surfactant into the acidic solution to obtain an electrolyte system; and step 3, placing a metal substrate in the electrolyte system for electrodeposition to obtain the composite membrane with self-repairing function.

Optionally, in the step 1, a mass ratio of the cobalt salt, the tungsten salt, the complexing agent and the buffering agent is 15-20:8-10:25-30:4-8.

The cobalt salt together with the tungsten salt can form a cobalt-tungsten alloy on the metallic material substrate to improve the properties of the metallic material substrate such as corrosion resistance, heat resistance and wear resistance; the complexing agent provides performance of brightening, levelling and buffering in the present application; and the buffering agent serves as a buffer and improvement in the present application.

Optionally, in the step 1, adjusting the pH value specifically includes adjusting the pH value to 4-6.

Too high a pH value induces fissures in the coating, and too low a pH value inhibits the growth of the coating and reduces a thickness of the membrane.

Optionally, in the step 2, a temperature of the acidic solution is in a range of 40-60 degrees Celsius (° C.).

Too high or too low a temperature leads to fissures of the coating.

Optionally, in the step 2, a mass ratio of the cerium oxide to the surfactant is in a range of 1-2:8.

Optionally, a mass ratio of the cobalt salt to the cerium oxide is in a range of 15-20:1-2.

Optionally, the cobalt salt is cobalt sulfate; the tungsten salt is sodium tungstate; the complexing agent is diammonium hydrogen citrate; the buffering agent is ammonium acetate; the cerium oxide is cerium dioxide; and the surfactant is sodium dodecyl sulfonate.

Optionally, concentrations of the cobalt salt, the tungsten salt, the diammonium hydrogen citrate, the ammonium acetate, the cerium oxide and the surfactant in the mixed solution are 15-20 grams per liter (g/L), 8-10 g/L, 25-30 g/L, 4-8 g/L, 1-2 g/L and 8 g/L, respectively.

Optionally, a particle size of the cerium dioxide is in a range of 500 nanometers (nm)–1 micrometer (μm).

Optionally, in the step 3, the electrodeposition specifically includes: adopting a constant potential to carry out composite electrodeposition, using a platinum sheet as a counter electrode, and using a three-electrode system consisting of a saturated potassium chloride solution, a salt bridge and a calomel electrode to deposit under a stirring condition with a rotating speed of 100-200 revolutions per minute (r/min) and a potential of −1.0-−1.2 Volts (V), and taking out after 3,000-3,600 seconds (s).

The composite electrodeposition is followed by steps of washing with water, tearing off insulating tape and drying, where the drying is blow-drying with cold air.

Another technical scheme of the present application provides a composite membrane with self-repairing function prepared by the preparation method mentioned above.

Another technical scheme of the present application provides an application of the composite membrane with self-repairing function in treating surfaces of metallic materials.

Optionally, the composite membrane with self-repairing function is deposited on the surfaces of the metallic materials by electrodeposition.

The composite membrane with fissures is exposed to air for 7 days and the fissures do not heal; the composite membrane with fissures is exposed to the corrosive medium $Cl^-$ for 7 days and the fissures heal. The reason for this is that in a corrosive environment, ion exchange and dissolution occur at the point where the coating breaks down, forming a physical barrier that enables self-healing and also corrosion resistance.

The technical concept of the present application is that:

making metallic materials fissures self-healing is possible from both the perspectives of prevention of fissures and the self-healing of the material after fissures appear; on the one hand, it is found by research that the initial stage of fissures is the result of internal stress, and that appropriate surface treatment techniques to relieve internal stress can inhibit stress concentration during service, thus preventing fissures from increasing or even breaking; on the other hand, coating with self-healing function is designed according to the self-healing mechanism, which is mainly through the simulation of damage self-healing mechanism of biological system in nature, so that the material is capable of self-healing when damaged; self-repairing materials are capable of reacting to changes in the external environment, integrating sensing, actuation and information processing; as such, it is of great importance to develop a composite membrane with self-healing function so as to enable it with good fissure self-healing function.

The present application discloses the following technical effects:

the present application uses cobalt-tungsten co-deposition by constant potential composite electrodeposition on a metallic material substrate, which eventually forms a micron-scale composite membrane with a self-healing function and a thickness of 6-8 μm on the surface of the metallic material, and this composite membrane is continuous and complete with a dense structure and a hardness of 251.0 Vickers Hardness (HV); in case of fissures on the membrane surface, the fissures heal when the membrane is placed in a 3.5 weight percentage (wt. %) NaCl solution for 7 days, i.e. in the presence of the corrosive medium $Cl^-$;

based on the existing cobalt salt and tungsten salt to form an acidic solution, the present application combines the two salts, whereby the cobalt salt and tungsten salt can form a cobalt-tungsten alloy on the metallic material, with good corrosion resistance, heat resistance and wear resistance, and the wear resistance of the substrate can be greatly improved to achieve the effect of delaying the formation of fissures; cerium dioxide particles itself is insoluble in water, it forms a mixed solution with cerium dioxide particles with sodium dodecyl sulfate; on the one hand, cerium dioxide plays a role in producing self-repair effect by utilizing the valence change of $Ce^{4+}/Ce^{3+}$ cerium element, where the higher the concentration of cerium, the shorter the self-repair period and the better the self-repair effect; on the other hand, sodium dodecyl sulfate serves to prevent agglomeration of cerium dioxide particles, increasing its content in the composite coating and improving the self-healing rate of fissures; in addition, the present application employs constant potential deposition to produce a composite coating that is wear resistant, stable and has self-healing characteristics in terms of fissures, which enable the metallic material (substrate) to have a good self-healing function in terms of fissures during service as well as resistance to wear and corrosion;

the preparation method of the present application is easy to operate, clean and environmentally friendly, suitable for workpieces of various shapes that have requirements for fissure resistance, wear resistance and corrosion resistance of metallic materials in service, with a wide range of application and easy industrialization; and the composite membrane with self-healing function prepared by the present application does not heal in the absence of corrosive medium, while it is capable of healing in the presence of the corrosive medium $Cl^-$ instead; and if fissures appear in the metal workpiece coated with the composite membrane of the present application during service, the fissures will not only not develop in the longitudinal direction but will heal when the corrosive medium $Cl^-$ is present in the environment, which is of great significance for extending the service life of the metal workpieces.

BRIEF DESCRIPTION OF THE DRAWINGS

In order to illustrate more clearly the technical schemes in the embodiments of the present application or in the prior art, a brief description of the accompanying drawings to be used in the embodiments is given below. It is obvious that the accompanying drawings in the following description are only some embodiments of the present application and that other accompanying drawings are available to those of ordinary skill in the art without any creative effort.

DETAILED DESCRIPTION OF THE EMBODIMENTS

Various exemplary embodiments of the present application are now described in detail and this detailed description should not be considered a limitation of the present application, but should be understood as a further detailed description of certain aspects, features and embodiments of the present application.

It should be understood that the terminology described in the present application is only for describing specific embodiments and is not used to limit the present application. In addition, for the numerical range in the present application, it should be understood that each intermediate value between the upper limit and the lower limit of the range is also specifically disclosed. The intermediate value within any stated value or stated range and every smaller range between any other stated value or intermediate value within the stated range are also included in the present application. The upper and lower limits of these smaller ranges are independently included or excluded from the range.

Unless otherwise specified, all technical and scientific terms used herein have the same meaning as commonly understood by one of ordinary skill in the art to which this present application relates. Although the present application only describes the preferred methods and materials, any methods and materials similar or equivalent to those described herein can also be used in the practice or testing of the present application. All documents mentioned in this specification are incorporated by reference to disclose and describe methods and/or materials related to the documents. In case of conflict with any incorporated document, the contents of this specification shall prevail.

It is obvious to those skilled in the art that many improvements and changes are available to the specific embodiments of the present application without departing from the scope or spirit of the present application. Other embodiments will be apparent to the skilled person from the description of the present application. The description and embodiments of the present application are exemplary only.

The terms "including", "comprising", "having" and "containing" used in this specification are all open terms, which means including but not limited to.

A method for adjusting pH values in the embodiments of the present application is as follows: depending on the acidity or alkalinity of the solution, alkaline substances (sodium hydroxide) or acidic substances (diluted sulfuric acid) are added to the solution to adjust the pH of the solution.

The fissures in the embodiments of the present application are manually scratched fissures using an insulin needle and are approximately 20-40 micrometers (μm) in diameter.

Figure 11:
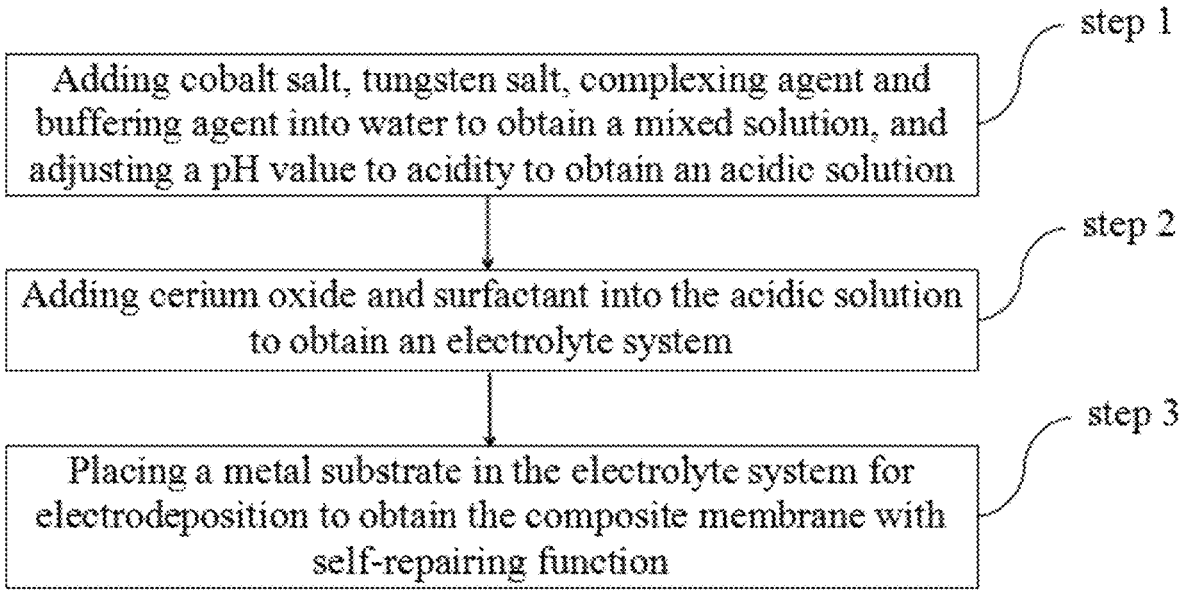
FIG. 11 illustrates a process of a preparation method of a composite membrane with self-repairing function according to an embodiment of the present application.

The present application provides a preparation method of a composite membrane with self-repairing function, including following steps as shown in FIG. 11:

step 1, adding cobalt salt, tungsten salt, complexing agent and buffering agent into water to obtain a mixed solution, and adjusting a pH value to acidity to obtain an acidic solution;

step 2, adding cerium oxide and surfactant into the acidic solution to obtain an electrolyte system; and step 3, placing a metal substrate in the electrolyte system for electrodeposition to obtain the composite membrane with self-repairing function.

Embodiment 1 step 1, cobalt sulfate, sodium tungstate, diammonium hydrogen citrate and ammonium acetate are sequentially added into solvent water to be mixed and dissolved, and evenly stirred, where the concentrations of each component are: cobalt sulfate 16.9 grams per liter (g/L), sodium tungstate 9.9 g/L, diammonium hydrogen citrate 27.1 g/L and ammonium acetate 4.6 g/L respectively; the temperature of the mixed solution is controlled to be constant at 25 degrees Celsius (° C.), and the pH value of the mixed solution is adjusted to be 4.7 to obtain an acidic solution;

step 2, in a reactor with a constant temperature of 50° C., cerium dioxide particles with a particle size of 1 μm are added to the above acidic solution (the concentration of cerium dioxide particles in the solution is 1.0 g/L), and sodium dodecyl sulfate is added to the above solution under stirring conditions (the concentration of sodium dodecyl sulfate in the solution is 8 g/L), and the solution is fully stirred and dispersed, and left to stand for 24 hours (h) to obtain an electrolyte system;

step 3, the metallic material is electrodeposited over an area of 2.0×2.0 centimeters (cm) and the non-deposited part of it is wrapped with insulating tape to obtain the treated metallic material; and step 4, the above treated metallic material is immersed in the electrolyte system prepared in step 2 and the composite electrodeposition is carried out using a constant potential, with the counter electrode being a platinum sheet (the counter electrode platinum sheet is immersed in concentrated nitric acid for 15 minutes (min) before use and then removed, washed with water and dried naturally), and a three-electrode system consisting of a saturated potassium chloride solution, a salt bridge and a glycerol electrode is used for the deposition under stirring conditions at a speed of 100 r/min with a potential of −1.2 Volts (V) for 3,600 seconds (s); the composite membrane with a self-healing function is obtained after taking it out, washing it with water and blowing it dry with a cooler.

Figure 1:
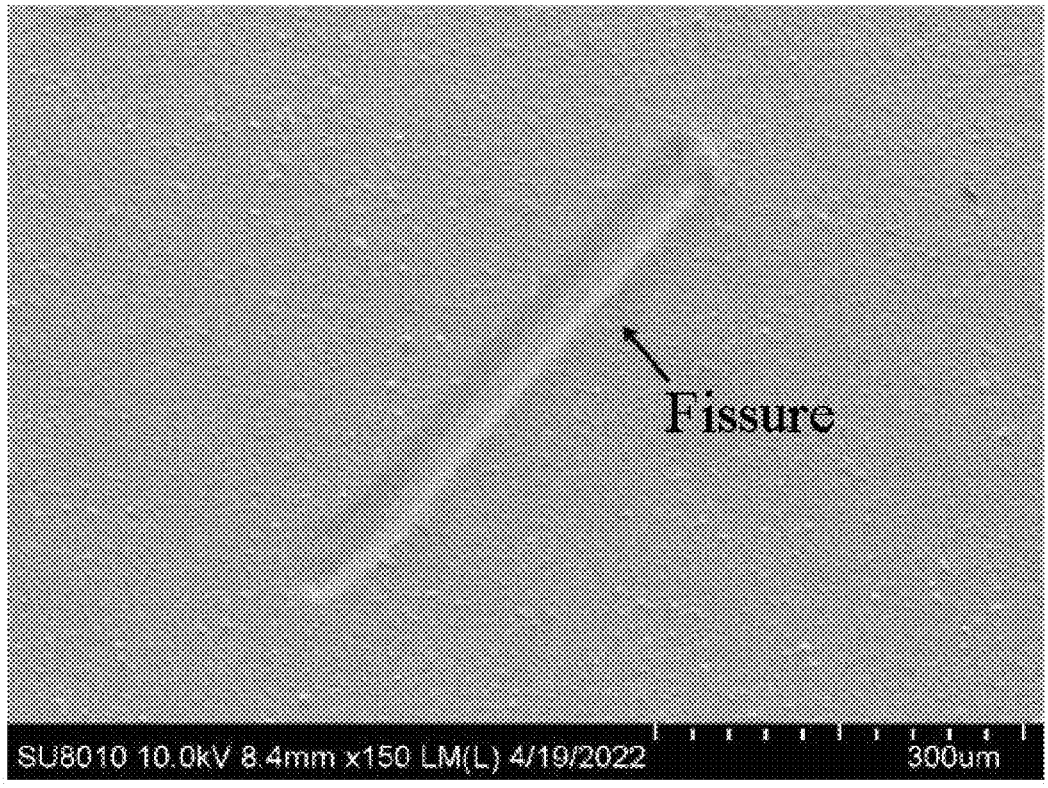
FIG. 1 shows a surface morphology diagram of a composite membrane with self-repairing function prepared in Embodiment 1.

The surface morphology of the composite membrane prepared by this embodiment is observed under the scanning electron microscope, and the results are shown in FIG. 1. It can be seen from FIG. 1 that the surface of the composite membrane prepared by this embodiment is dense and free of fissures. The thickness of the composite membrane prepared by this embodiment is tested to be 7.46 μm and the hardness is 223.96 Vickers Hardness (HV).

Figure 2:
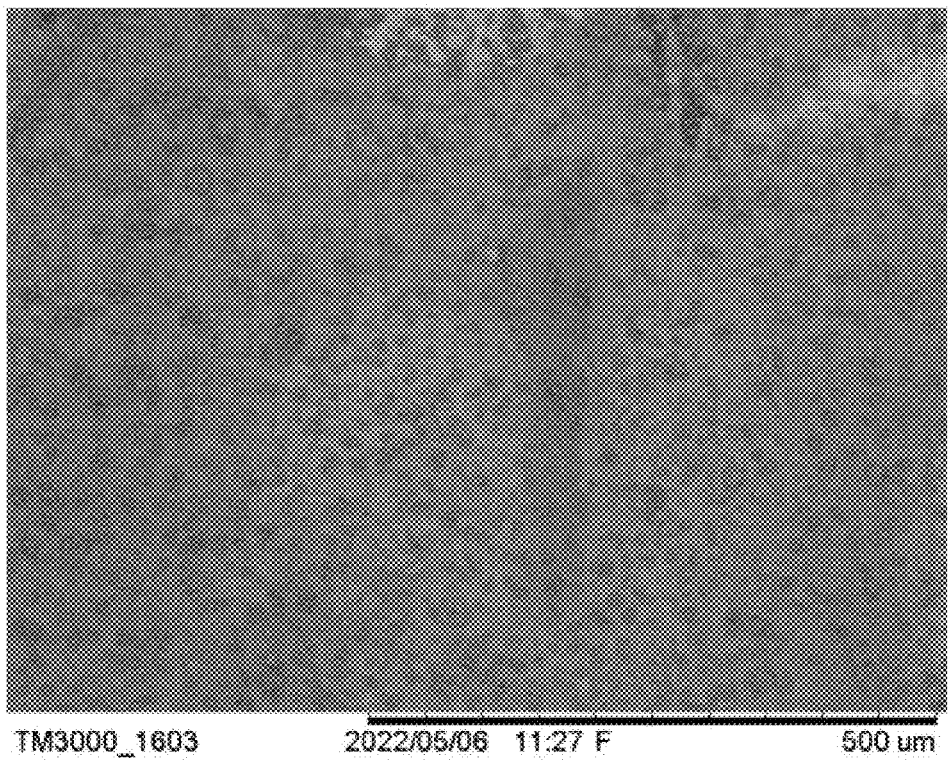
FIG. 2 shows a surface morphology diagram of the composite membrane with self-healing function prepared in Embodiment 1 after being placed in 3.5 weight percentage (wt. %) NaCl solution for 7 days.

If there are fissures, the membrane is placed in 3.5 wt. % NaCl solution for 7 days and the fissures are healed. The composite membrane placed in 3.5 wt. % NaCl solution for 7 days is again observed under the scanning electron microscope for the surface morphology, with the results as shown in FIG. 2, which show that the fissures on the surface of the composite membrane are healed after treatment with NaCl solution.

If there are fissures, the immersion in NaCl solution is omitted and the surface morphology of the membrane is observed under scanning electron microscopy after 7 days of exposure to air, and the results of the scanning electron microscopy test show that the composite membrane fissures are not healed.

Embodiment 2 step 1, cobalt sulfate, sodium tungstate, diammonium hydrogen citrate and ammonium acetate are sequentially added into solvent water to be mixed and dissolved, and evenly stirred, where the concentrations of each component are: cobalt sulfate 16.9 g/L, sodium tungstate 9.9 g/L, diammonium hydrogen citrate 27.1 g/L and ammonium acetate 4.6 g/L respectively; the temperature of the mixed solution is controlled to be constant at 25° C., and the pH value of the mixed solution is adjusted to be 4.7 to obtain an acidic solution;

step 2, in a reactor with a constant temperature of 50° C., cerium dioxide particles with a particle size of 500 nm are added to the above acidic solution (the concentration of cerium dioxide particles in the solution is 1.6 g/L), and sodium dodecyl sulfate is added to the above solution under stirring conditions (the concentration of sodium dodecyl sulfate in the solution is 8 g/L), and the solution is fully stirred and dispersed, and left to stand for 24 h to obtain an electrolyte system;

step 3, the metallic material is electrodeposited over an area of 2.0×2.0 cm and the non-deposited part of it is wrapped with insulating tape to obtain the treated metallic material; and step 4, the above treated metallic material is immersed in the electrolyte system prepared in step 2 and the composite electrodeposition is carried out using a constant potential, with the counter electrode being a platinum sheet (the counter electrode platinum sheet is immersed in concentrated nitric acid for 15 min before use and then removed, washed and dried naturally), and a three-electrode system consisting of a saturated potassium chloride solution, a salt bridge and a glycerol electrode is used for the deposition under stirring conditions at a speed of 100 r/min with a potential of −1.2 V for 3,600 s; the composite membrane with a self-healing function is obtained after taking it out, washing it with water and blowing it dry with a cooler.

Figure 3:
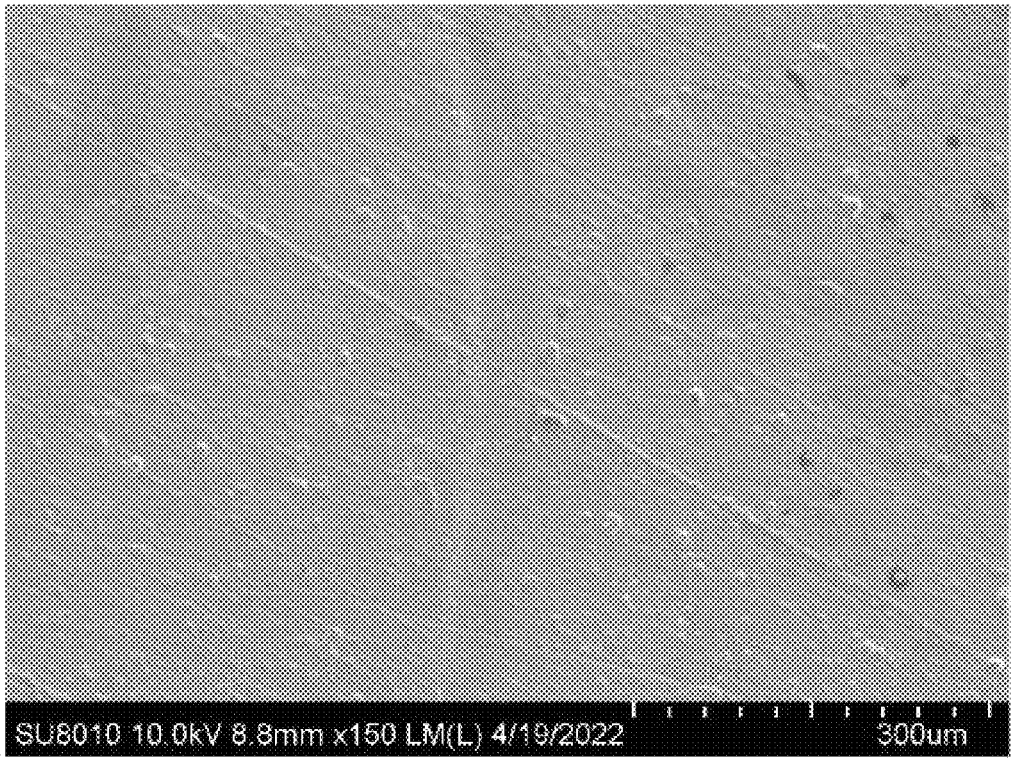
FIG. 3 shows a surface morphology diagram of a composite membrane with self-repairing function prepared in Embodiment 2.

The surface morphology of the composite membrane prepared by this embodiment is observed under the scanning electron microscope, and the results are shown in FIG. 3. It can be seen from FIG. 3 that the surface of the composite membrane prepared by this embodiment is dense and free of fissures. The thickness of the composite membrane prepared by this embodiment is tested to be 6.26 μm and the hardness is 221.71 HV.

Figure 4:
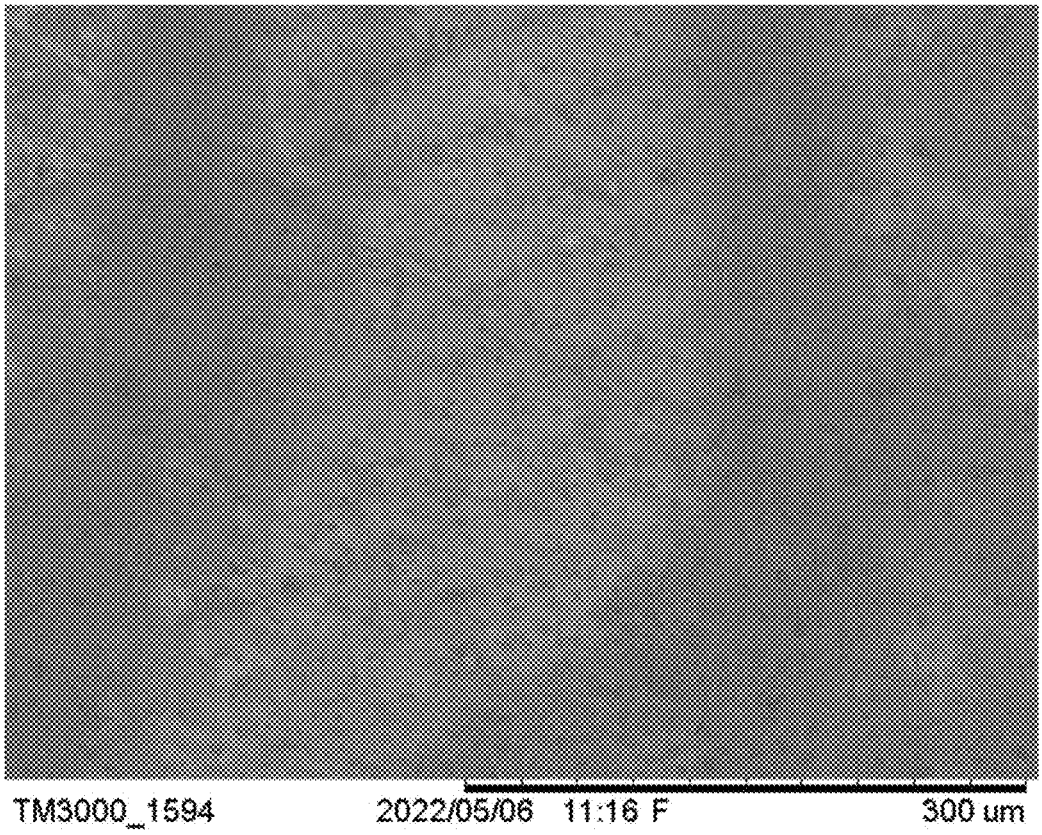
FIG. 4 shows a surface morphology diagram of the composite membrane with self-healing function prepared in Embodiment 2 after being placed in 3.5 wt. % NaCl solution for 7 days.

If there are fissures, the membrane is placed in 3.5 wt. % NaCl solution for 7 days and the fissures are healed. The composite membrane placed in 3.5 wt. % NaCl solution for 7 days is again observed under the scanning electron microscope for the surface morphology, with the results shown in FIG. 4, which show that the fissures on the surface of the composite membrane are healed after treatment with NaCl solution.

Embodiment 3 step 1, cobalt sulfate, sodium tungstate, diammonium hydrogen citrate and ammonium acetate are sequentially added into solvent water to be mixed and dissolved, and evenly stirred, where the concentrations of each component are: cobalt sulfate 16.9 g/L, sodium tungstate 9.9 g/L, diammonium hydrogen citrate 27.1 g/L and ammonium acetate 4.6 g/L respectively; the temperature of the mixed solution is controlled to be constant at 25° C., and the pH value of the mixed solution is adjusted to be 4.7 to obtain an acidic solution;

step 2, in a reactor with a constant temperature of 50° C., cerium dioxide particles with a particle size of 500 nm are added to the above acidic solution (the concentration of cerium dioxide particles in the solution is 1.2 g/L), and sodium dodecyl sulfate is added to the above solution under stirring conditions (the concentration of sodium dodecyl sulfate in the solution is 8 g/L), and the solution is fully stirred and dispersed, and left to stand for 24 h to obtain an electrolyte system;

step 3, the metallic material is electrodeposited over an area of 2.0×2.0 cm and the non-deposited part of it is wrapped with insulating tape to obtain the treated metallic material; and step 4, the above treated metallic material is immersed in the electrolyte system prepared in step 2 and the composite electrodeposition is carried out using a constant potential, with the counter electrode being a platinum sheet (the counter electrode platinum sheet is immersed in concentrated nitric acid for 15 min before use and then removed, washed and dried naturally), and a three-electrode system consisting of a saturated potassium chloride solution, a salt bridge and a glycerol electrode is used for the deposition under stirring conditions at a speed of 100 r/min with a potential of −1.2 V for 3,600 s; the composite membrane with a self-healing function is obtained after taking it out, washing it with water and blowing it dry with a cooler.

Figure 5:
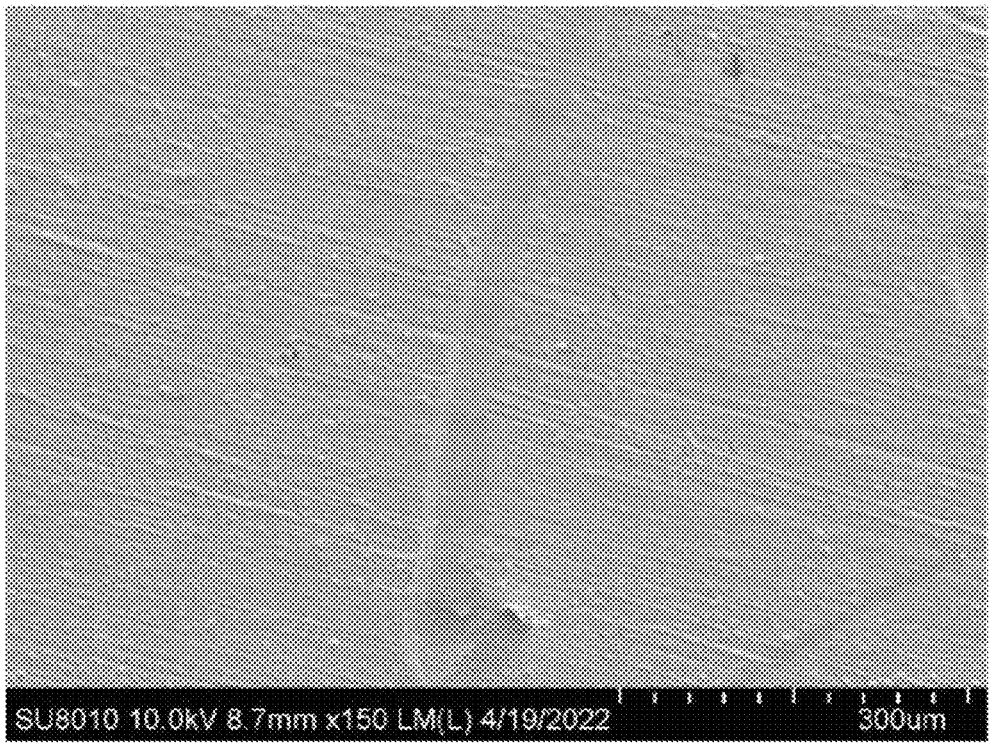
FIG. 5 shows a surface morphology diagram of a composite membrane with self-repairing function prepared in Embodiment 3.

The surface morphology of the composite membrane prepared by this embodiment is observed under the scanning electron microscope, and the results are shown in FIG. 5. It can be seen from FIG. 5 that the surface of the composite membrane prepared by this embodiment is dense and free of fissures. The thickness of the composite membrane prepared by this embodiment is tested to be 6.40 μm and the hardness is 233.31 HV.

The composite membrane prepared in this embodiment is subjected to the same fissure repair test as in Embodiment 1, and the results show that after the composite membrane develops fissures and being placed in a 3.5 wt. % NaCl solution for 7 days, the fissures are healed.

Embodiment 4 step 1, cobalt sulfate, sodium tungstate, diammonium hydrogen citrate and ammonium acetate are sequentially added into solvent water to be mixed and dissolved, and evenly stirred, where the concentrations of each component are: cobalt sulfate 16.9 g/L, sodium tungstate 9.9 g/L, diammonium hydrogen citrate 27.1 g/L and ammonium acetate 4.6 g/L respectively; the temperature of the mixed solution is controlled to be constant at 25° C., and the pH value of the mixed solution is adjusted to be 4.7 to obtain an acidic solution;

step 2, in a reactor with a constant temperature of 50° C., cerium dioxide particles with a particle size of 1 μm are added to the above acidic solution (the concentration of cerium dioxide particles in the solution is 1.6 g/L), and sodium dodecyl sulfate is added to the above solution under stirring conditions (the concentration of sodium dodecyl sulfate in the solution is 8 g/L), and the solution is fully stirred and dispersed, and left to stand for 24 h to obtain an electrolyte system;

step 3, the metallic material is electrodeposited over an area of 2.0×2.0 cm and the non-deposited part of it is wrapped with insulating tape to obtain the treated metallic material; and step 4, the above treated metallic material is immersed in the electrolyte system prepared in step 2 and the composite electrodeposition is carried out using a constant potential, with the counter electrode being a platinum sheet (the counter electrode platinum sheet is immersed in concentrated nitric acid for 15 min before use and then removed, washed and dried naturally), and a three-electrode system consisting of a saturated potassium chloride solution, a salt bridge and a glycerol electrode is used for the deposition under stirring conditions at a speed of 100 r/min with a potential of −1.2 V for 3,600 s; the composite membrane with a self-healing function is obtained after taking it out, washing it with water and blowing it dry with a cooler.

Figure 6:
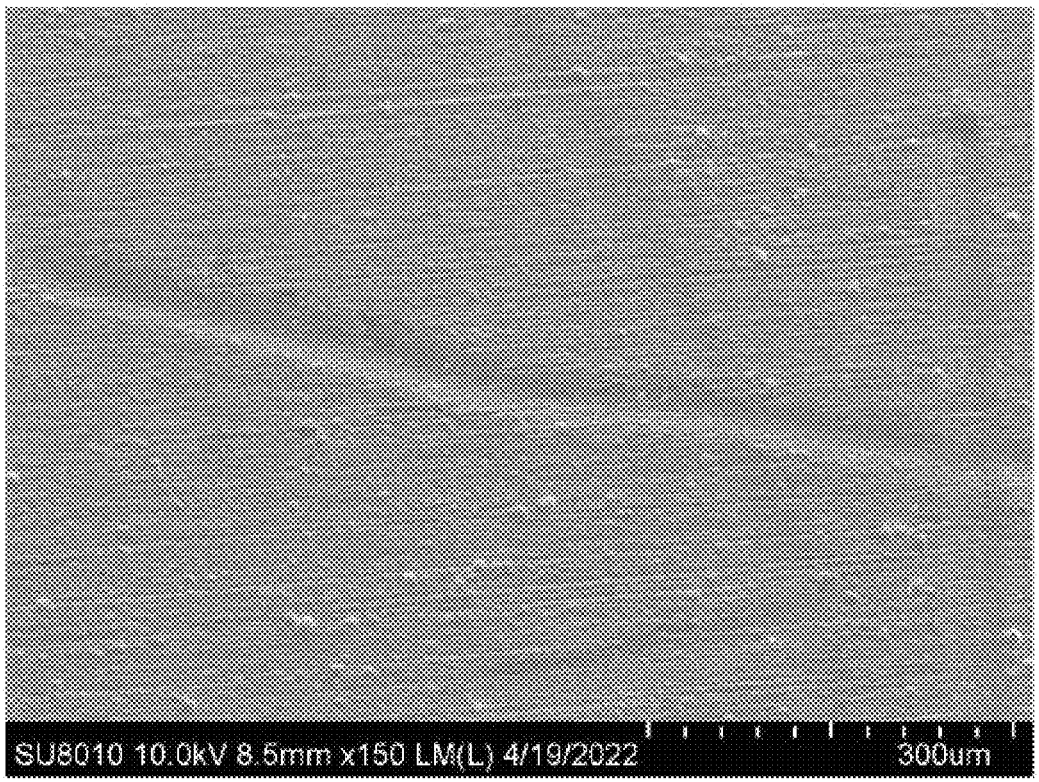
FIG. 6 shows a surface morphology diagram of a composite membrane with self-repairing function prepared in Embodiment 4.

The surface morphology of the composite membrane prepared by this embodiment is observed under the scanning electron microscope, and the results are shown in FIG. 6. It can be seen from FIG. 6 that the surface of the composite membrane prepared by this embodiment is dense and free of fissures. The thickness of the composite membrane prepared by this embodiment is tested to be 6.00 μm and the hardness is 243.05 HV.

The composite membrane prepared in this embodiment is subjected to the same fissure repair test as in Embodiment 1, and the results show that after the composite membrane develops fissures and being placed in a 3.5 wt. % NaCl solution for 7 days, the fissures are healed.

Embodiment 5 step 1, cobalt sulfate, sodium tungstate, diammonium hydrogen citrate and ammonium acetate are sequentially added into solvent water to be mixed and dissolved, and evenly stirred, where the concentrations of each component are: cobalt sulfate 16.9 g/L, sodium tungstate 9.9 g/L, diammonium hydrogen citrate 27.1 g/L and ammonium acetate 4.6 g/L respectively; the temperature of the mixed solution is controlled to be constant at 25° C., and the pH value of the mixed solution is adjusted to be 4.7 to obtain an acidic solution;

step 2, in a reactor with a constant temperature of 50° C., cerium dioxide particles with a particle size of 500 nm are added to the above acidic solution (the concentration of cerium dioxide particles in the solution is 2.0 g/L), and sodium dodecyl sulfate is added to the above solution under stirring conditions (the concentration of sodium dodecyl sulfate in the solution is 8 g/L), and the solution is fully stirred and dispersed, and left to stand for 24 h to obtain an electrolyte system;

step 3, the metallic material is electrodeposited over an area of 2.0×2.0 cm and the non-deposited part of it is wrapped with insulating tape to obtain the treated metallic material; and step 4, the above treated metallic material is immersed in the electrolyte system prepared in step 2 and the composite electrodeposition is carried out using a constant potential, with the counter electrode being a platinum sheet (the counter electrode platinum sheet is immersed in concentrated nitric acid for 15 min before use and then removed, washed and dried naturally), and a three-electrode system consisting of a saturated potassium chloride solution, a salt bridge and a glycerol electrode is used for the deposition under stirring conditions at a speed of 100 r/min with a potential of −1.2 V for 3,600 s; the composite membrane with a self-healing function is obtained after taking it out, washing it with water and blowing it dry with a cooler.

Figure 7:
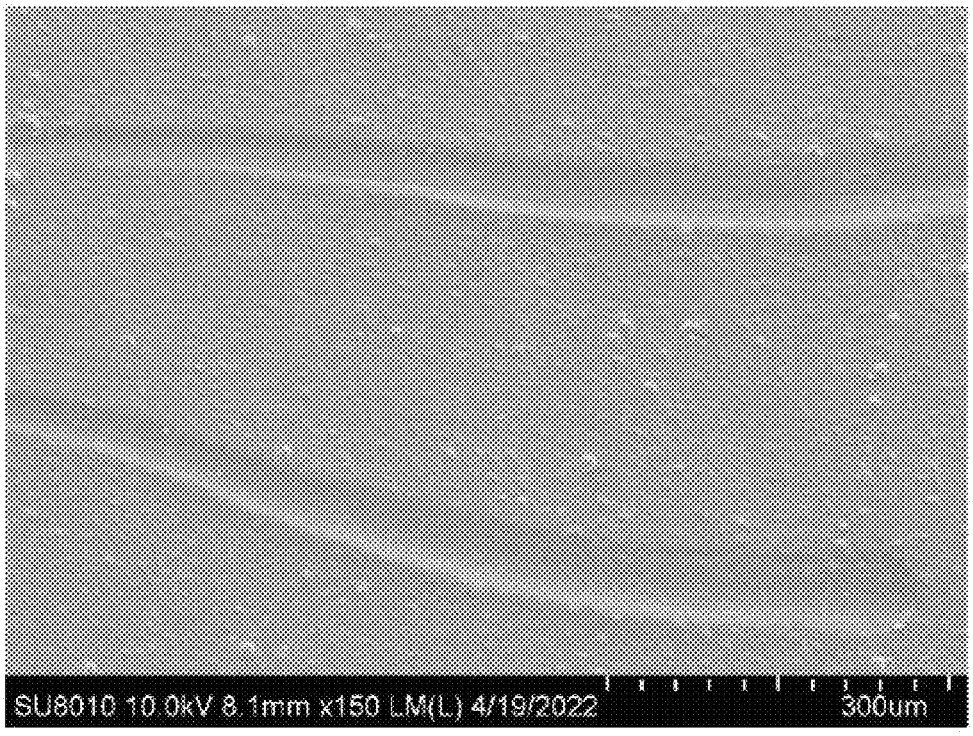
FIG. 7 shows a surface morphology diagram of a composite membrane with self-repairing function prepared in Embodiment 5.

The surface morphology of the composite membrane prepared by this embodiment is observed under the scanning electron microscope, and the results are shown in FIG. 7. It can be seen from FIG. 7 that the surface of the composite membrane prepared by this embodiment is dense and free of fissures. The thickness of the composite membrane prepared by this embodiment is tested to be 5.96 μm and the hardness is 252.99 HV.

The composite membrane prepared in this embodiment is subjected to the same fissure repair test as in Embodiment 1, and the results show that after the composite membrane develops fissures and being placed in a 3.5 wt. % NaCl solution for 7 days, the fissures heal.

Embodiment 6 step 1, cobalt sulfate, sodium tungstate, diammonium hydrogen citrate and ammonium acetate are sequentially added into solvent water to be mixed and dissolved, and evenly stirred, where the concentrations of each component are: cobalt sulfate 16.9 g/L, sodium tungstate 9.9 g/L, diammonium hydrogen citrate 27.1 g/L and ammonium acetate 4.6 g/L respectively; the temperature of the mixed solution is controlled to be constant at 25° C., and the pH value of the mixed solution is adjusted to be 4.7 to obtain an acidic solution;

step 2, in a reactor with a constant temperature of 50° C., cerium dioxide particles with a particle size of 1 μm are added to the above acidic solution (the concentration of cerium dioxide particles in the solution is 1.2 g/L), and sodium dodecyl sulfate is added to the above solution under stirring conditions (the concentration of sodium dodecyl sulfate in the solution is 8 g/L), and the solution is fully stirred and dispersed, and left to stand for 24 h to obtain an electrolyte system;

step 3, the metallic material is electrodeposited over an area of 2.0×2.0 cm and the non-deposited part of it is wrapped with insulating tape to obtain the treated metallic material; and step 4, the above treated metallic material is immersed in the electrolyte system prepared in step 2 and the composite electrodeposition is carried out using a constant potential, with the counter electrode being a platinum sheet (the counter electrode platinum sheet is immersed in concentrated nitric acid for 15 min before use and then removed, washed and dried naturally), and a three-electrode system consisting of a saturated potassium chloride solution, a salt bridge and a glycerol electrode is used for the deposition under stirring conditions at a speed of 100 r/min with a potential of −1.2 V for 3,600 s; the composite membrane with a self-healing function is obtained after taking it out, washing it with water and blowing it dry with a cooler.

Figure 8:
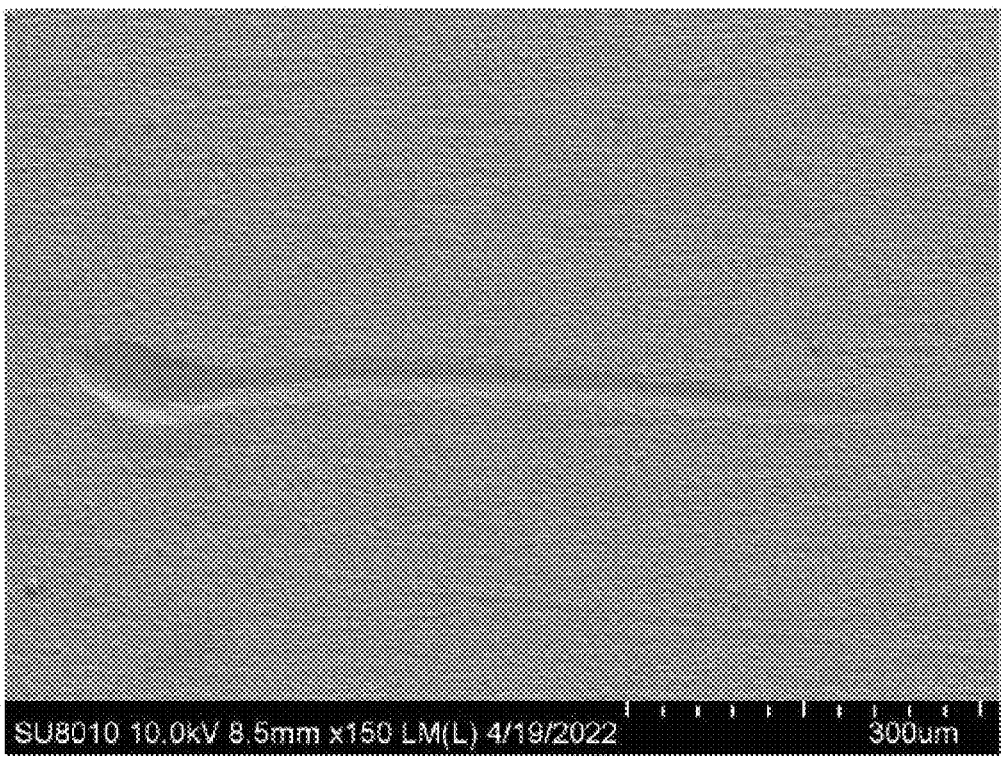
FIG. 8 shows a surface morphology diagram of a composite membrane with self-repairing function prepared in Embodiment 6.

The surface morphology of the composite membrane prepared by this embodiment is observed under the scanning electron microscope, and the results are shown in FIG. 8. It can be seen from FIG. 8 that the surface of the composite membrane prepared by this embodiment is dense and free of fissures. The thickness of the composite membrane prepared by this embodiment is tested to be 6.50 μm and the hardness is 241.02 HV.

The composite membrane prepared in this embodiment is subjected to the same fissure repair test as in Embodiment 1, and the results show that after the composite membrane develops fissures and being placed in a 3.5 wt. % NaCl solution for 7 days, the fissures heal.

Comparative Embodiment 1

Same as Embodiment 1, except that the addition of sodium dodecyl sulfate in step 2 is omitted.

Figure 9:
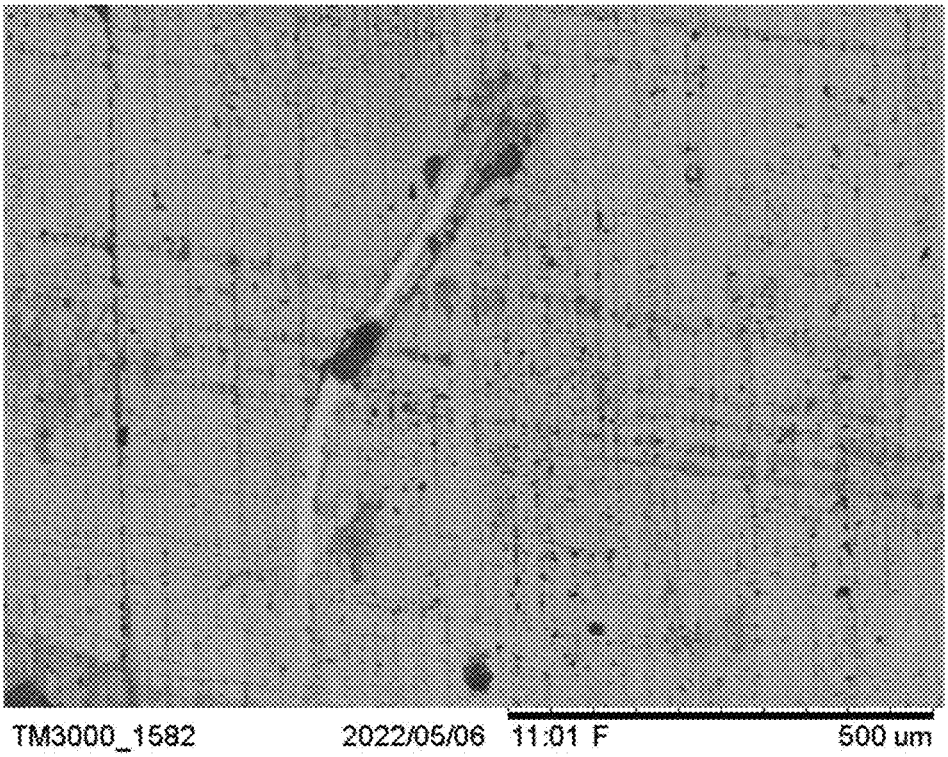
FIG. 9 shows a surface morphology diagram of a composite membrane with self-repairing function prepared in Comparative embodiment 1.

The surface morphology of the composite membrane prepared by this comparative embodiment is observed under the scanning electron microscope, and the results are shown in FIG. 9. It can be seen from FIG. 9 that the surface of the composite membrane prepared by this comparative embodiment is dense and free of fissures. The thickness of the composite membrane prepared by this comparative embodiment is tested to be 5.10 μm and the hardness is 218.28 HV.

The composite membrane prepared in this comparative embodiment is tested for fissure repair in the same manner as Embodiment 1, and the results show that after the composite membrane develops fissures and is placed in a 3.5 wt. % NaCl solution for 7 days, the fissure healing rate decreases and the healing performance is poor.

Comparative Embodiment 2

Same as Embodiment 1, except that the addition of cerium dioxide particles and sodium dodecyl sulfate in step 2 is omitted.

Figure 10:
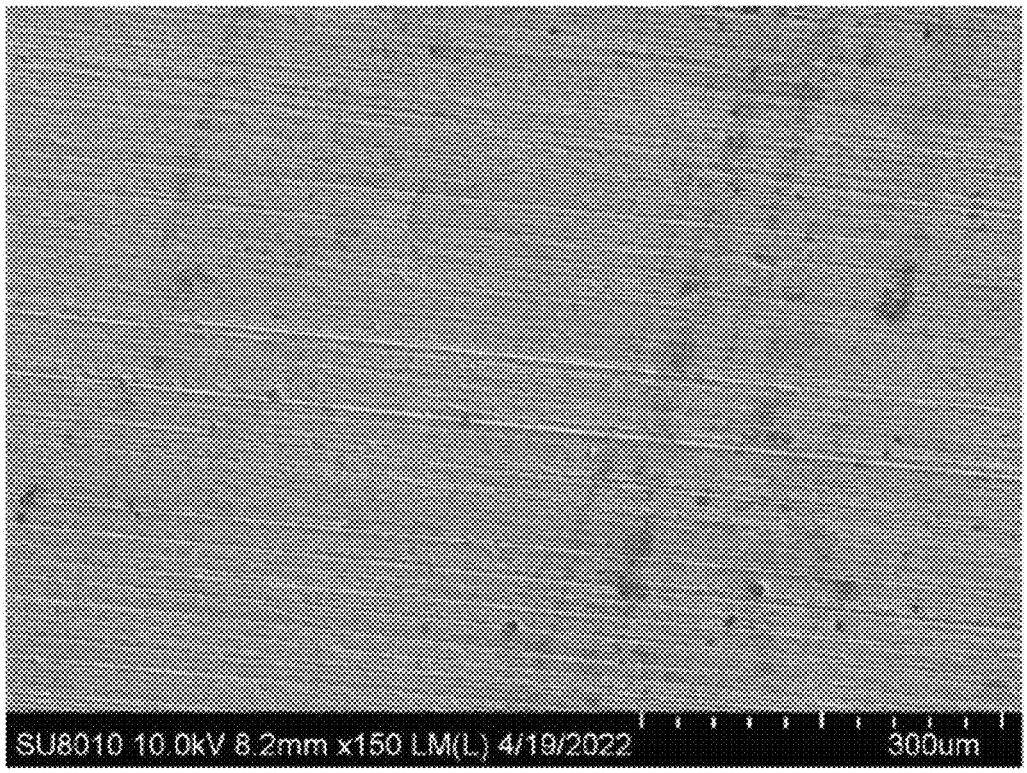
FIG. 10 shows a surface morphology diagram of an alloy film prepared in Comparative embodiment 2.

The surface morphology of the composite membrane prepared by this comparative embodiment is observed under the scanning electron microscope, and the results are shown in FIG. 10. It can be seen from FIG. 10 that the surface of the composite membrane prepared by this comparative embodiment is very dense and free of fissures. The thickness of the composite membrane prepared by this comparative embodiment is tested to be 2.5 μm and the hardness is 132.81 HV.

The composite membrane prepared in this comparative embodiment is tested for fissure repair in the same manner as Embodiment 1, and the results show that after the composite membrane develops fissures and is placed in a 3.5 wt. % NaCl solution for 7 days, the fissures do not change and do not heal.

Comparative Embodiment 3

Same as Embodiment 1, except that the particle size of the cerium dioxide particles in step 2 is 500 nm.

The surface morphology of the composite membrane prepared by this comparative embodiment is observed under scanning electron microscopy, which shows that the surface of the composite membrane is flat with a few fissures. The thickness of the composite membrane is tested to be 5.70 μm and the hardness is 184.06 HV.

When fissures are present (same as in Embodiment 1, manual scratching of fissures with an insulin needle, about 20-40 μm in diameter), the membrane is placed in a 3.5 wt. % NaCl solution for 7 days and the fissures are healed.

The embodiments described above are only a description of the preferred way of the present application and are not intended to limit the scope of the present application. Without departing from the design spirit of the present application, all kinds of variations and improvements made to the technical schemes of the present application by persons of ordinary skill in the art shall fall within the scope of protection determined by the claims of the present application.

What is claimed is:

1. A preparation method of a composite membrane with a self-repairing function, comprising following steps:

step 1, adding cobalt salt, tungsten salt, a complexing agent and a buffering agent into water to obtain a mixed solution, and adjusting a pH value to acidify to obtain an acidic solution, wherein a mass ratio of the cobalt salt, the tungsten salt, the complexing agent and the buffering agent is 15-20:8-10:25-30:4-8;

step 2, adding cerium oxide and surfactant into the acidic solution to obtain an electrolyte system, wherein a mass ratio of the cerium oxide to the surfactant is in a range of 1-2:8; and step 3, placing a metal substrate in the electrolyte system for electrodeposition to obtain the composite membrane with the self-repairing function.

2. The preparation method of the composite membrane with the self-repairing function according to claim 1, wherein in the step 1, adjusting the pH value specifically is adjusting the pH value to 4-6.

3. The preparation method of the composite membrane with the self-repairing function according to claim 1, wherein in the step 2, a temperature of the acidic solution is in a range of 40-60 degrees Celsius.

4. The preparation method of the composite membrane with the self-repairing function according to claim 1, wherein a mass ratio of the cobalt salt to the cerium oxide is in a range of 15-20:1-2.

5. The preparation method of the composite membrane with the self-repairing function according to claim 1, wherein the cobalt salt is cobalt sulfate, the tungsten salt is sodium tungstate, the complexing agent is diammonium hydrogen citrate, the buffering agent is ammonium acetate, the cerium oxide is cerium dioxide, and the surfactant is sodium dodecyl sulfonate.

6. The preparation method of the composite membrane with the self-repairing function according to claim 1, wherein the composite membrane is deposited on the surfaces of the metallic materials by electrodeposition.

* * * * *